US008241056B2

(12) United States Patent
Sun

(10) Patent No.: US 8,241,056 B2
(45) Date of Patent: Aug. 14, 2012

(54) RJ-45 CONNECTOR

(75) Inventor: Zheng-Heng Sun, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/973,809

(22) Filed: Dec. 20, 2010

(65) Prior Publication Data

US 2012/0149234 A1 Jun. 14, 2012

(30) Foreign Application Priority Data

Dec. 10, 2010 (CN) ..... 2010 1 0582864

(51) Int. Cl.
*H01R 3/00* (2006.01)

(52) U.S. Cl. ..... 439/490

(58) Field of Classification Search ..... 439/489
See application file for complete search history.

(56) References Cited

U.S. PATENT DOCUMENTS

| | | | | |
|---|---|---|---|---|
| 6,361,357 | B1 * | 3/2002 | Stillwell et al. | 439/490 |
| 6,361,370 | B1 * | 3/2002 | Neiser | 439/638 |
| 7,922,519 | B1 * | 4/2011 | Sun | 439/490 |
| 8,002,577 | B1 * | 8/2011 | Sun | 439/490 |

* cited by examiner

*Primary Examiner* — Truc Nguyen
(74) *Attorney, Agent, or Firm* — Altis Law Group, Inc.

(57) ABSTRACT

A Registered Jack-45 (RJ-45) connector includes a main body, a cable, and a light reflecting member. The cable is electrically connected to a rear end of the main body. The light reflecting member includes a base placed on a rear end of a top of the main body, two slanted light reflecting portions extending up and back from the base, and a fixing portion formed on a rear end of the base, to engage with the cable.

4 Claims, 2 Drawing Sheets

RJ-45 CONNECTOR

CROSS-REFERENCE OF RELATED APPLICATION

Relevant subject matter is disclosed in a co-pending U.S. patent application, titled "RJ-45 CONNECTOR," and filed on Nov. 17, 2010, with the application Ser. No. 12/947,836, which is assigned to the same assignee as this patent application.

BACKGROUND

1. Technical Field

The present disclosure relates to a Registered Jack-45 (RJ-45) connector.

2. Description of Related Art

RJ-45 connectors are widely used in network communication. In use, an RJ-45 connector is engaged in an interface of a chassis of a computer or a server. The interface includes two light emitting diodes, used to indicate whether the network connection is working properly. However, in most cases, the interface is defined in a rear end of the chassis, thus light generated by the light emitting diodes is only seen from the back of the chassis, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawing, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
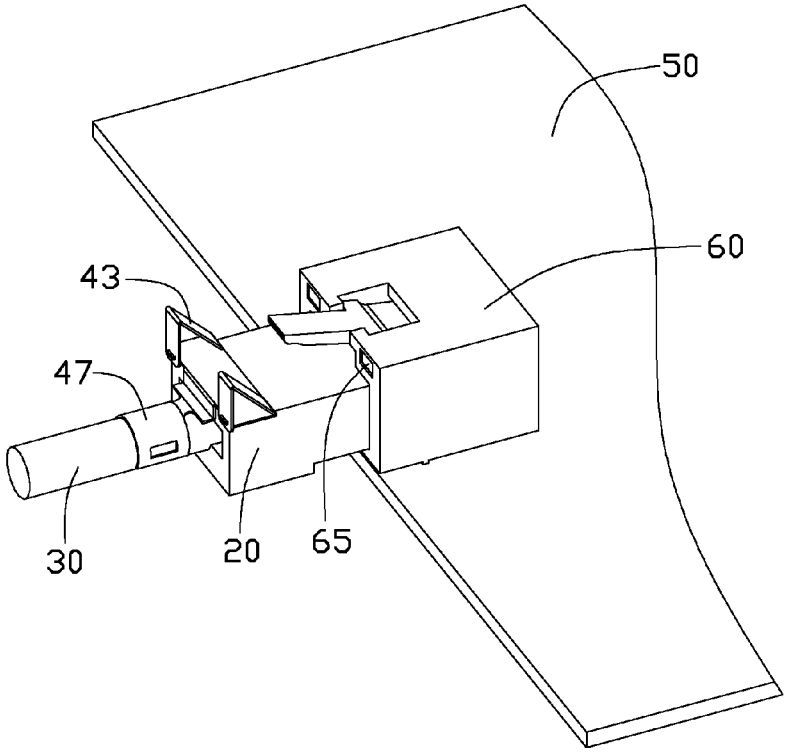
FIG. 1 is an assembled, isometric view of an embodiment of a Registered Jack-45 (RJ-45) connector together with a motherboard.
Figure 2:
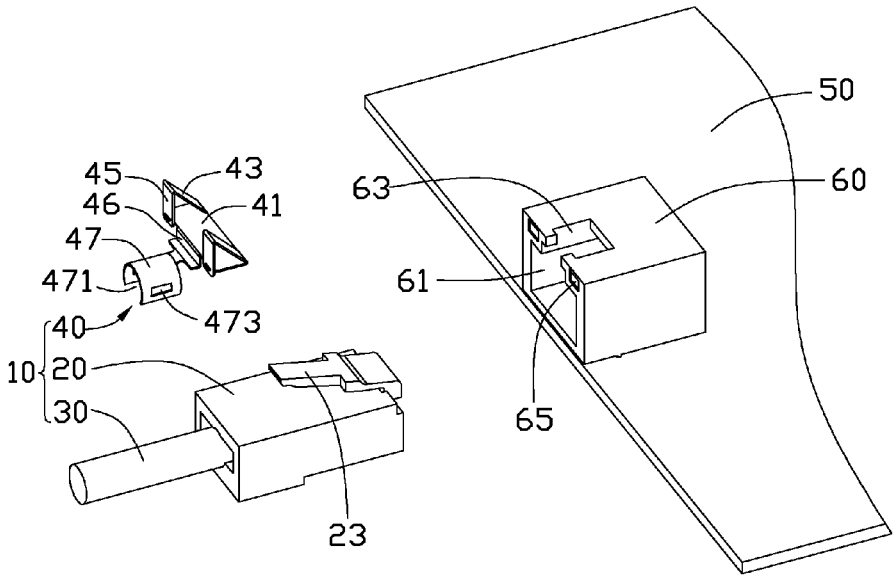
FIG. 2 is an exploded, isometric view of FIG. 1.

Referring to FIGS. 1 and 2, an embodiment of a Registered Jack-45 (RJ-45) connector 10 is provided to be electrically connected to a connector 60 of a motherboard 50. The RJ-45 connector 10 includes a main body 20, a cable 30 electrically connected to a rear end of the main body 20, and a light reflecting member 40.

A resilient latch 23 is formed on a front end of a top of the main body 20.

The light reflecting member 40 includes a base 41. Two slanted light reflecting portions 43 extend up and back from a front end of the base 41. A supporting portion 45 is connected between a top of each light reflecting portion 43 and a rear end of the base 41, for supporting the corresponding light reflecting portion 43. A substantially L-shaped connecting portion 46 extends down from the rear end of the base 41, and a substantially C-shaped fixing portion 47 is connected to a rear end of the connecting portion 46. An opening 471 is defined in a lateral side of the fixing portion 47. Two through holes 473 are respectively defined in two sections of the fixing portion 47 bounding opposite sides of the opening 471. In this embodiment, the light reflecting portions 43 are made of light reflecting metal, such as stainless steel. In other embodiments, the light reflecting portions 43 are coated with reflective material, such as mirror-coating, or shiny fabric or film.

A receiving space 61 is defined in a rear end of the connector 60. A latching slot 63 is defined in a rear end of a top of the connector 60 in communication with the receiving space 61. Two light emitting diodes 65 are mounted at the rear end of the connector 60 above the receiving space 61, and are arranged at opposite sides of the latching slot 63.

To assemble the RJ-45 connector 10, the base 41 of the light reflecting member 40 is placed on the rear end of the top of the main body 20. The cable 30 is engaged in the fixing portion 47 from the opening 471. Thereby, the light reflecting member 40 is fixed to the main body 20 and the cable 30.

To connect the RJ-45 connector 10 to the connector 60 of the motherboard 50, a front end of the RJ-45 connector 10 is inserted into the receiving space 61 of the connector 60, with the resilient latch 23 engaging in the latching slot 63. The light reflecting portions 43 of the light reflecting member 40 respectively align with the light emitting diodes 65 of the connector 60. The light reflecting portions 43 reflect light generated by the light emitting diodes 65 forward and upward. Therefore, the light can be easily seen.

In other embodiments, a cable binding ribbon can be provided to extend through the through holes 473 of the fixing portion 47, and bind the cable 30 to the fixing portion 47, to prevent the cable 30 from being loosened.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A Registered Jack-45 (RJ-45) connector, comprising:

a main body;

a cable electrically connected to a rear end of the main body; and a light reflecting member comprising a base placed on a rear end of a top of the main body, two slanted light reflecting portions extending up from the base, and a fixing portion formed on a rear end of the base, to engage with the cable, wherein a substantially L-shaped connecting portion extends down from the rear end of the base, and the fixing portion is connected to a rear end of the connecting portion.

2. The RJ-45 connector of claim 1, wherein the light reflecting portions are made of light reflecting metal.

3. The RJ-45 connector of claim 1, wherein the light reflecting portions are coated with mirror-coating, or shiny fabric or film.

4. The RJ-45 connector of claim 1, wherein the fixing portion is substantially C-shaped, and an opening is defined in a lateral side of the fixing portion.

* * * * *